US005890497A

United States Patent [19]

Tsai

[11] Patent Number: 5,890,497

[45] Date of Patent: Apr. 6, 1999

[54] HAIR BINDER

[76] Inventor: Kai-Mou Tsai, 4/F., No. 1, Lane 135, Tao-Hsiang Rd., Peitou Dist., Taipei City, Taiwan

[21] Appl. No.: 33,952

[22] Filed: Mar. 3, 1998

[51] Int. Cl.[6] ..... A45D 8/04; A45D 8/12; A45D 8/20; A41F 1/00

[52] U.S. Cl. ..... 132/273; 132/275; 132/276; 132/277; 24/616; 24/615

[58] Field of Search ..... 132/273, 274, 132/275, 277, 278; 24/616, 615, 625

[56] References Cited

U.S. PATENT DOCUMENTS

| | | | |
|---|---|---|---|
| D. 50,668 | 4/1917 | Steiner . | |
| 536,965 | 4/1895 | Neuberger | 132/273 |
| 2,272,514 | 2/1942 | Davis | 132/48 |
| 2,488,954 | 11/1949 | Winters | 132/48 |
| 5,027,481 | 7/1991 | Frano | 24/606 |
| 5,709,014 | 1/1998 | Takahashi | 24/614 |
| 5,774,957 | 7/1998 | Kohl et al. | 24/701 |

FOREIGN PATENT DOCUMENTS

| | | | |
|---|---|---|---|
| 2226129 | 11/1974 | France | 24/616 |
| 2574262 | 6/1986 | France | 24/616 |

*Primary Examiner*—John J. Wilson
*Assistant Examiner*—Trang Doan
*Attorney, Agent, or Firm*—Rosenberg, Klein & Bilker

[57] ABSTRACT

A hair binder including a cord member, and a quick-release hook for joining the ends of the cord member, the quick-release hook including a male member and a female member injection-molded from plastics and respectively fastened to the ends of the cord member, the male member having two springy hooks, the female member having two coupling portions for engagement with the springy hooks of the male member, and two release control press portions for squeezing by hand to disengage the coupling portions from the spring hooks.

3 Claims, 4 Drawing Sheets

HAIR BINDER

BACKGROUND OF THE INVENTION

The present invention relates to a hair binder for arranging the hair, and more particularly to such a hair binder which is comprised of a cord member, and a quick-release hook for joining the ends of the cord member.

A regular hair binder, as shown in FIG. 7, is comprised of an elastic band 31, and a metal clamp 3 fixedly fastened to the elastic band 31 to secure the ends of the elastic band 31 together. Because the metal clamp 3 is fixedly fastened to the elastic band 31, the ends of the elastic band 31 cannot be opened. When in use, the elastic band 31 must be twisted into loops for fastening to the hair. Further, because the metal clamp 3 has edges, the user's fingers tend to be injured by the edges of the metal clamp 3 or the hair tends to be damaged by the metal clamp 3 when fastening the elastic band 31 to the hair. FIG. 8 shows a regular necklace which is comprised of a string of beads 53, a swivel male connector 51 with a screw rod 52 at one end of the string of beads 53, and a female connector 5 with a screw hole at an opposite end of the string of beads 53. When in use, the screw rod 52 of the swivel male connector 51 is threaded into the screw hole on the female connector 5. FIG. 9 shows another structure of necklace. This structure of necklace is comprised of a string of beads 63, a link 6 with a knob-controlled tongue 61 at one end of the string of beads 63, and a fixed ring 62 at an opposite end of the string of beads 63. When in use, the knob-controlled tongue 61 is pulled back to open the link 6 for permitting the fixed ring 62 to be inserted into the link 6, then the knob-controlled tongue 6 is released from the hand and forced by a spring in the link 6 to close the link 6. In the aforesaid necklaces, the swivel male connector 51, the female connector 5, the link 6 and the fixed ring 62 are made from metal and electroplated with a metal coating. The coating wears quickly with use

SUMMARY OF THE INVENTION

The present invention provides a hair binder which is comprised of a cord member, and a quick-release hook for joining the ends of the cord member. The quick-release hook is comprised of a male member fixedly fastened to a first end of the cord member, and a female member fixedly fastened to a second end of the cord member and releasably connected to the male member. The male member is comprised of a first hook block and a second hook block respectively injection-molded from plastics, the first hook block and the second hook block each having a springy hook at one end, plug rods and plug holes at an inner side. The first hook block and the second hook block are fastened together by plugging the plug rods of one hook block into the plug holes on the other hook block. The female member is comprised of a first receptacle block and a second receptacle block respectively injection-molded from plastics. The first receptacle block and the second receptacle block each have a coupling portion at one end for engagement with the springy hooks of the male member, a release-control press portion behind the coupling portion for pressing by hand to disengage the coupling portion from the springy hooks of said male member, plug rods and plug holes at an inner side. The first receptacle block and the second receptacle block are fastened together by plugging the plug rods of one receptacle block into the plug holes on the other receptacle block. The coupling portions each have a smoothly curved guide face for guiding the springy hooks of the male member into engagement position.

DETAILED DESCRIPTION OF THE PREFERRED EMBODIMENT

Figure 1:
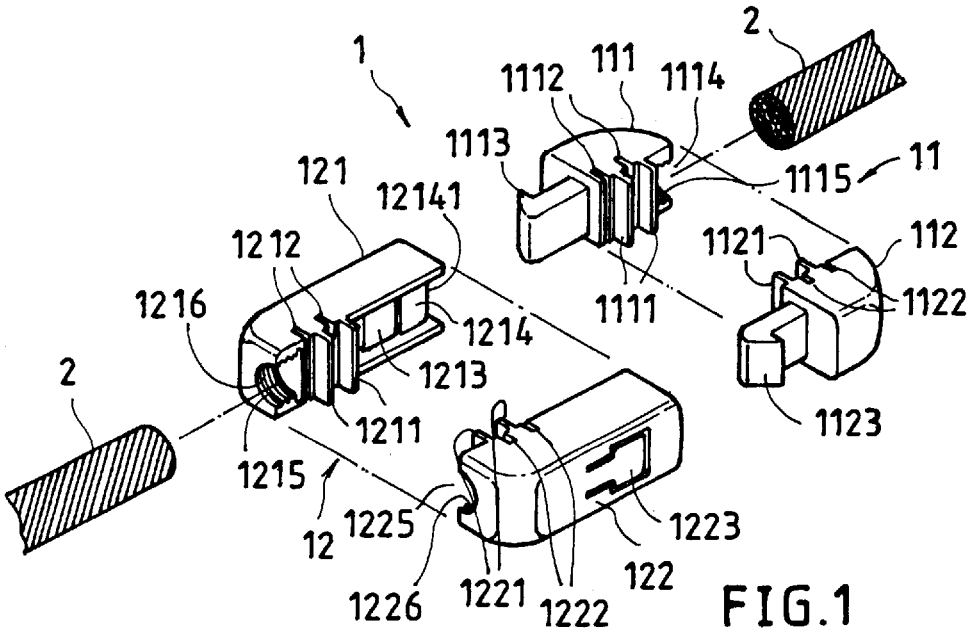
FIG. 1 is an exploded view of a hair binder according to the present invention.

Referring to FIGS. from 1 to 4, a hair binder in accordance with the present invention is generally comprised of a cord member 2, and a quick release hook 1. The quick release hook 1 is comprised of a male member 11, and a female member 12. The male member 11 is comprised of a first hook block 111, and a second hook block 112. The first hook block 111 and the second hook block 112 are made from plastics by injection molding, each having a springy hook 1113;1123 at one end namely the front end, a semi-circular hole 1114;1124 at an opposite end namely the rear end, serrations 1115;1125 in the semi-circular hole 1114;1124, plug rods 1111;1121 and plug holes 1112;1122 at an inner side. By plugging respective plug rods 1111;1121 into respective plug holes 1112;1122, the first hook block 111 and the second hook block 112-are fastened together. During the assembly process, one end of the cord member 2 is inserted into the semi-circular holes 1113;1124 on the hook blocks 111;112. When the first hook block 111 and the second hook block 112 are fastened together, the serrations 1115;1125 are forced into engagement with the cord member 2. Further, the connecting area between the hook blocks 111;112 is sealed by a ultrasonic sealing apparatus.

The female member 12 is comprised of a first receptacle block 121, and a second receptacle block 122. The first receptacle block 121 and the second receptacle block 122 are made from plastics by injection molding, each having a coupling portion 1214;1224 at one end namely the front end, a release control press portion 1213;1223 behind the coupling portion 1214;1224, a semi-circular hole 1215;1225 at an opposite end namely the rear end, serrations 1216;1226 in the semi-circular hole 1215;1225, plug rods 1211;1221 and plug holes 1212;1222 at an inner side. By plugging respective plug rods 1211;1221 into respective plug holes 1212;1222, the first receptacle block 121 and the second receptacle block 122 are fastened together. During the assembly process of the female member 12, the other end of the cord member 2 is inserted into the semi-circular holes 1215;1225 on the receptacle blocks 121;122. The coupling portion 1214;1224 has a smoothly curved guide face 12141;12241 for guiding the hook 1113;1123 of the corresponding hook block 111;112 into position. When the first receptacle block 121 and the second receptacle block 122 are fastened together, the serrations 1216;1226 are forced into engagement with the cord member 2. Further, the connecting area between the receptacle blocks 121;122 is sealed by a ultrasonic sealing apparatus.

Figure 2:
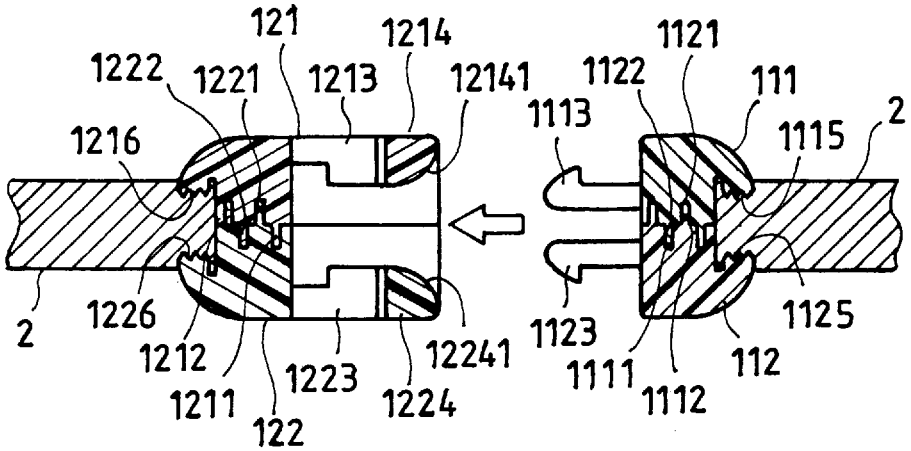
FIG. 2 is a sectional view of the male member and the female member of the quick-release hook according to the present invention.
Figure 3:
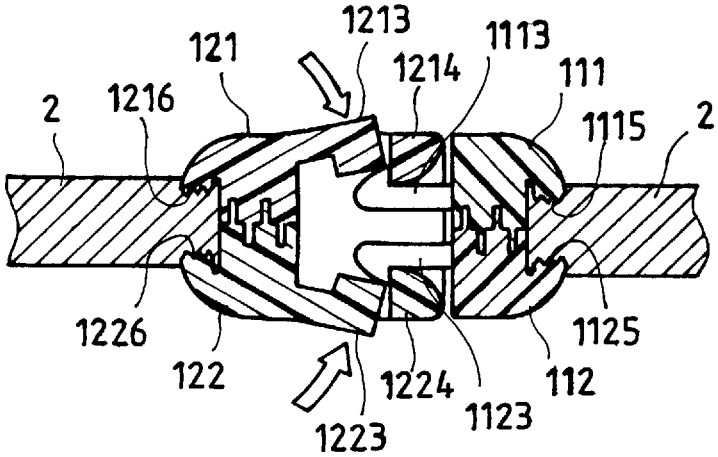
FIG. 3 is a sectional view showing the engagement between the male member and the female member of the quick-release hook according to the present invention.
Figure 4:
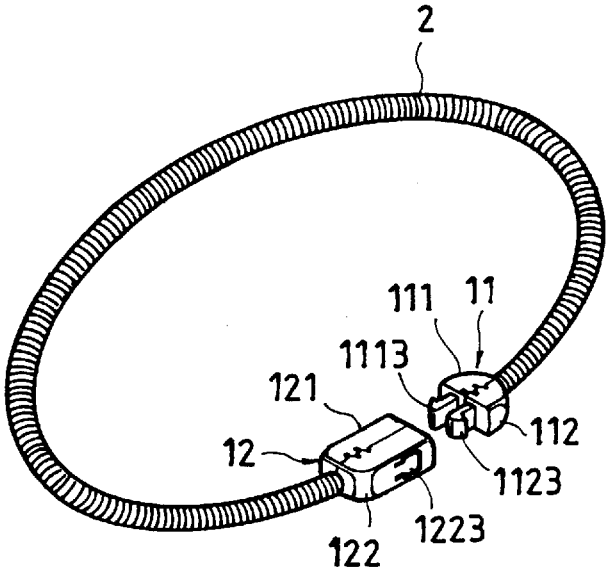
FIG. 4 is a perspective view of the hair binder according to the present invention.
Figure 5:
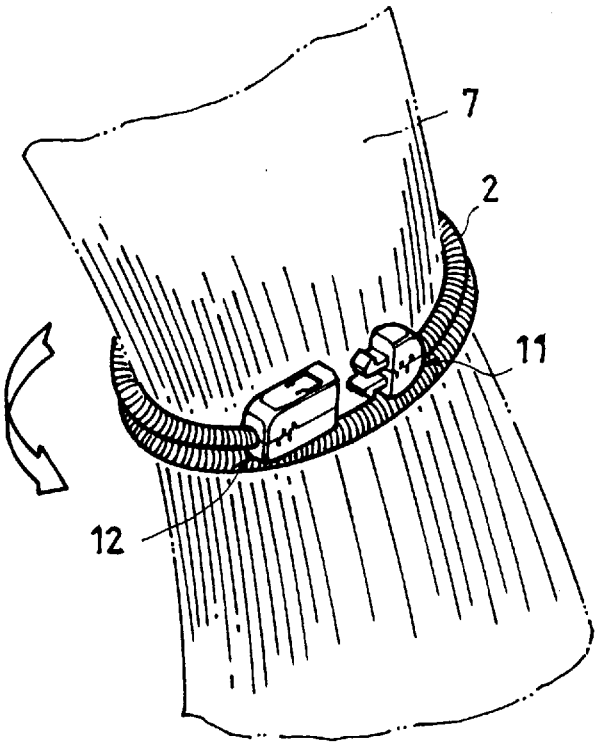
FIG. 5 is an applied view of the present invention, showing the hair binder fastened to the hair.
Figure 7:
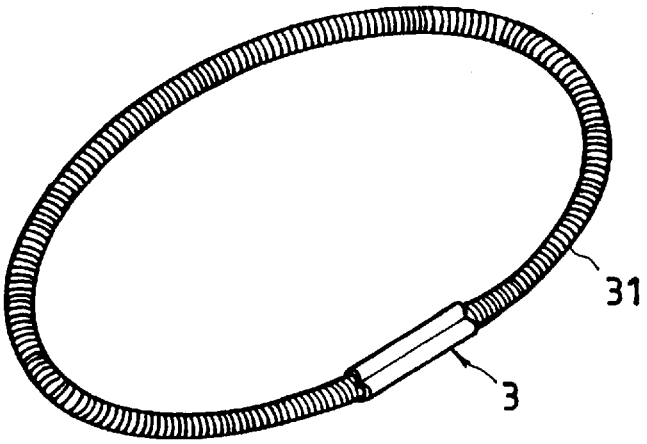
FIG.7 PRIOR ART
FIG. 7 is a perspective view of a hair binder according to the prior art.

Referring to FIG. 5 and FIGS. 2 and 3 again, when in use, the cord member 2 is wound round the hair 7, then the springy hook 1113;1123 of the hook block 111;112 of the male member 11 are inserted into the female member 12 and forced into engagement with the coupling portions 1214;1224 of the female member 12. When the springy hooks 1113;1123 are inserted in between the coupling portions 1214;1224 of the female member 12, the springy hooks 1113;1123 are compressed inwards and guided over the coupling portions 1214;1224 by the curved guide faces 12141;12241. After passing over the coupling portions 1214;1224, the springy hooks 1113;1123 immediately return to their former shape and respectively hook on the vertical rear side edges of the coupling portions 1214;1224, and therefore the hair binder is fastened to the hair 7. When the release control press portions 1213;1223 are pressed inwards toward each other, the springy hooks 1113;1123 are forced to disengage from the coupling portions 1214;1224, and therefore the male member 11 is connected from the female member 12.

Figure 6:
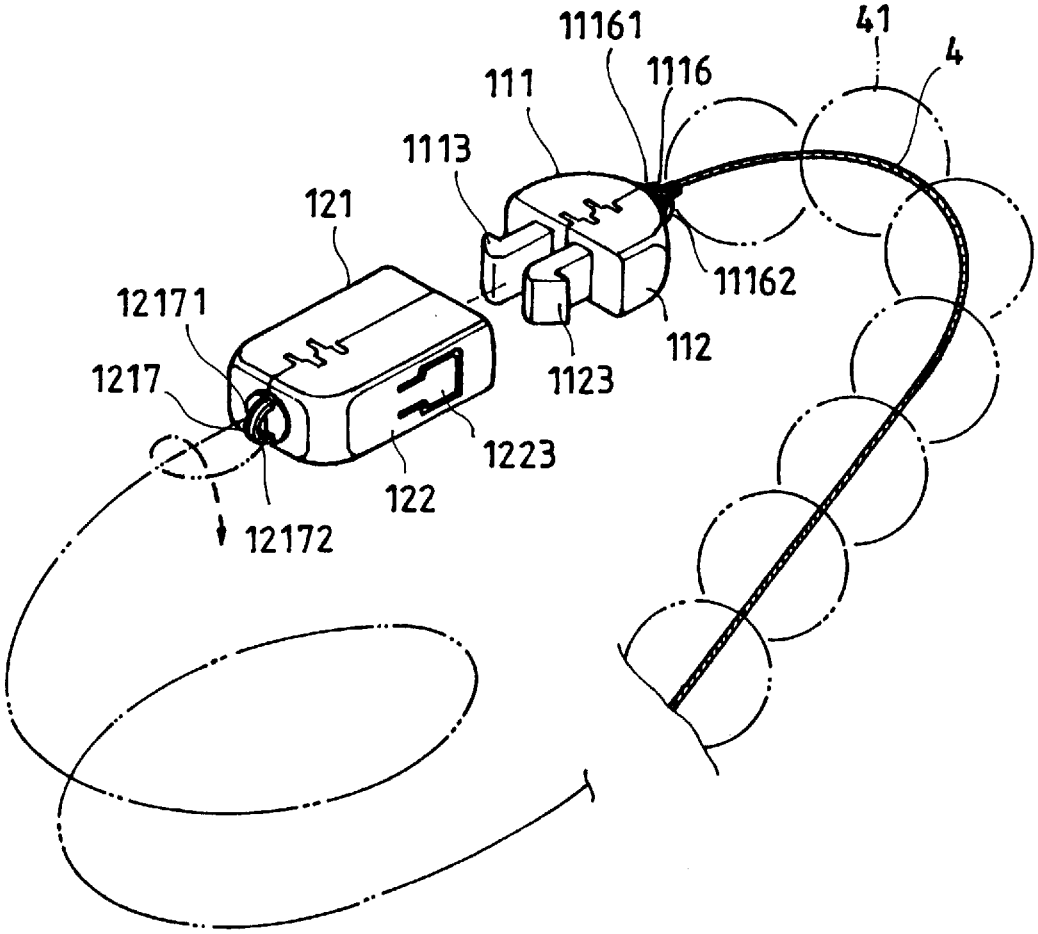
FIG. 6 is a perspective view of an alternate form of the hair binder according to the present invention.
Figure 8:
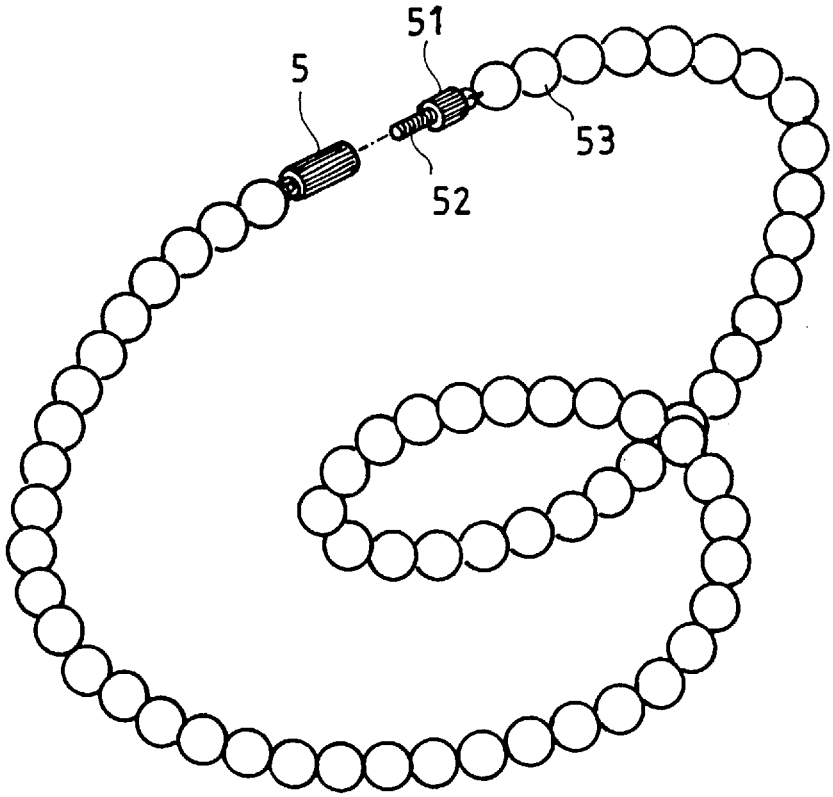
FIG.8 PRIOR ART
FIG. 8 is a perspective view of a necklace according to the prior art.
Figure 9:
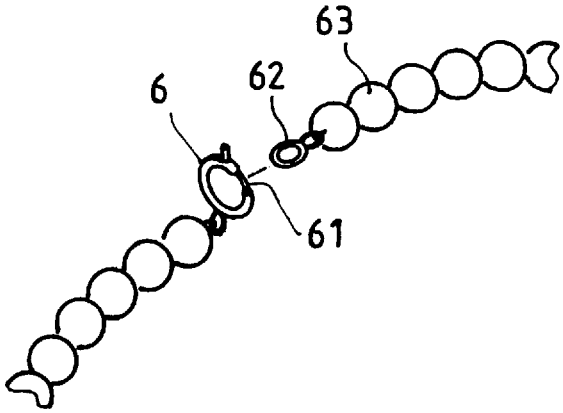
FIG.9 PRIOR ART
FIG. 9 is a perspective view of another structure of necklace according to the prior art.

FIG. 6 shows an alternate form of the hair binder. According to this alternate form, the hook blocks 111;112 of the male member 11 and the receptacle blocks 121;122 of the female member 12 have a respective ring 11161;11162, 12171;12172. When the hook blocks 111;112 or receptacle blocks 121;122 are fastened together, the rings 11161;11162 or 12171;12172 are abutted against each other, forming a ring 1116 or 1217. An elastic cord 4 which is ornamented with beads 41 is connected between the rings 1116;1217 at the male member 11 and the female member 12. The beads 41 can be made in one color, or in different colors as desired.

It is to be understood that the drawings are designed for purposes of illustration only, and are not intended as a definition of the limits and scope of the invention disclosed.

What the invention claimed is:

1. A hair binder comprising a cord member, and a quick-release hook for joining the ends of said cord member, said quick-release hook comprised of a male member fixedly fastened to a first end of said cord member, and a female member fixedly fastened to a second end of said cord member and releasably connected to said male member, wherein said male member is comprised of a first hook block and a second hook block respectively injection-molded from plastics, said first hook block and said second hook block each having a springy hook at one end, plug rods and plug holes at an inner side, said first hook block and said second hook block being fastened together by plugging the plug rods of one hook block into the plug holes on the other hook block; said female member is comprised of a first receptacle block and a second receptacle block respectively injection-molded from plastics, said first receptacle block and said second receptacle block each having a coupling portion at one end for engagement with the springy hooks of said male member, a release control press portion behind said coupling portion for pressing by hand to disengage said coupling portion from the springy hooks of said male member, plug rods and plug holes at an inner side, said first receptacle block and said second receptacle block being fastened together by plugging the plug rods of one receptacle block into the plug holes on the other receptacle block, said coupling portion having a smoothly curved guide face for guiding the corresponding springy hook of said male member into engagement position.

2. The hair binder of claim 1, wherein said first hook block and said second hook block each have a semi-circular hole at one end remote from the respective springy hook and serrations in the semi-circular hole for securing the first end of said cord member; said first receptacle block and said second receptacle block each have a semi-circular hole at one end remote from the respective coupling portion and serrations in the semi-circular hole for securing the second end of said cord member.

3. The hair binder of claim 1, wherein said male member and said female member each have a ring at one end for mounting said cord member; said cord member is ornamented with colored beads.

* * * * *